US010151143B2

(12) United States Patent
Keck et al.

(10) Patent No.: US 10,151,143 B2
(45) Date of Patent: Dec. 11, 2018

(54) SIGNAL LIGHT ASSEMBLY

(71) Applicant: LINDSAY TRANSPORTATION SOLUTIONS, INC., Omaha, NE (US)

(72) Inventors: Paul Keck, Callahan, FL (US); Nicholas Kent Bang, Omaha, NE (US); Benjamin Ryan Ossman, Council Bluffs, IA (US)

(73) Assignee: Lindsay Transportation Solutions, Inc., Rio Vista, CA (US)

( * ) Notice: Subject to any disclaimer, the term of this patent is extended or adjusted under 35 U.S.C. 154(b) by 180 days.

(21) Appl. No.: 15/247,556

(22) Filed: Aug. 25, 2016

(65) Prior Publication Data

US 2018/0058144 A1 Mar. 1, 2018

(51) Int. Cl.

| | |
|---|---|
| ***E06C 1/34*** | (2006.01) |
| ***E01F 9/604*** | (2016.01) |
| ***B61L 5/18*** | (2006.01) |
| ***E06C 7/16*** | (2006.01) |
| ***F21S 8/08*** | (2006.01) |
| *E04G 1/15* | (2006.01) |
| *E06C 9/02* | (2006.01) |
| *F21W 111/02* | (2006.01) |

(52) U.S. Cl.

CPC ..... *E06C 1/34* (2013.01); *B61L 5/1863* (2013.01); *E01F 9/604* (2016.02); *E06C 7/16* (2013.01); *F21S 8/086* (2013.01); *E04G 2001/156* (2013.01); *E06C 9/02* (2013.01); *F21W 2111/02* (2013.01)

(58) Field of Classification Search

CPC ..... E06C 1/02; E06C 1/14; E06C 1/24; E06C 9/02; E06C 1/34; E01F 9/604; B61L 5/1863

See application file for complete search history.

(56) References Cited

U.S. PATENT DOCUMENTS

| | | | | |
|---|---|---|---|---|
| 279,347 | A * | 6/1883 | Creecy | A62C 31/24 182/222 |
| 5,579,867 | A * | 12/1996 | Jarrel | E06C 1/10 182/116 |
| 5,639,047 | A * | 6/1997 | Boget | B61L 5/1827 246/473.3 |
| 5,810,114 | A * | 9/1998 | White | E04G 5/00 182/113 |
| 6,270,043 | B1 | 8/2001 | Alfrey | |
| 8,397,868 | B1 | 3/2013 | Ferree | |
| 8,771,544 | B2 * | 7/2014 | Hopper | E04F 11/02 252/185 |
| 9,151,112 | B2 * | 10/2015 | Niemela | E06C 1/04 |
| 9,434,457 | B2 * | 9/2016 | Volland | E02B 3/20 |
| 2008/0251316 | A1 * | 10/2008 | Libert | E04G 5/10 182/115 |
| 2010/0133210 | A1 * | 6/2010 | Champine, II | E06C 1/10 211/49.1 |
| 2010/0155176 | A1 * | 6/2010 | Lohr | E06C 7/16 182/113 |

(Continued)

FOREIGN PATENT DOCUMENTS

| | | |
|---|---|---|
| CA | 2246620 | 3/2000 |

*Primary Examiner* — Colleen M Chavchavadze

(74) *Attorney, Agent, or Firm* — Thomas R. Lampe

(57) ABSTRACT

An all welded signal light assembly transportable in secure, stacked condition with a plurality of all welded signal light assemblies of like construction.

3 Claims, 8 Drawing Sheets

(56) References Cited

U.S. PATENT DOCUMENTS

| | | | | |
|---|---|---|---|---|
| 2011/0114417 | A1* | 5/2011 | Daas | E04B 1/3445 182/115 |
| 2012/0080266 | A1 | 4/2012 | Brock | |
| 2015/0226002 | A1* | 8/2015 | Johansen | E06C 7/12 182/217 |
| 2016/0047165 | A1 | 2/2016 | King et al. | |

* cited by examiner

SIGNAL LIGHT ASSEMBLY

TECHNICAL FIELD

This invention relates to signal lights and more particularly to a signal light assembly for positioning along roadways, railways, etc.

BACKGROUND OF THE INVENTION

It is generally known to attach signal lights to signal light masts connected to ladders extending therealong. It is also known to incorporate with the mast and ladder of a signal mast assembly one or more support platforms accessible from the ladder.

The following patent documents are believed to be representative of the current state of the prior art in this field: U.S. Pat. No. 8,397,868, issued Mar. 19, 2013, U.S. Pat. No. 6,270,043, issued Aug. 7, 2001, U.S. Patent Appl. Publication No. US 2016/0047165, published Feb. 18, 2016, U.S. Patent Appl. Publication No. US 2012/0080266, published Apr. 5, 2012, and Canadian Patent No. 2,246,620, issued Mar. 4, 2000.

DISCLOSURE OF INVENTION

The signal light assembly of the present invention is an all welded assembly transportable in stacked condition with a plurality of signal light assemblies of like construction. The assemblies may be separately unstacked and separately installed at a selected location. When mast is installed, a ladder of the assembly may be bolted directly to foundation anchor bolts at the installation site.

The ladder extends along the elongated mast. This allows for two points of contact between the assembly and the foundation, one being with a base of the mast and a secondary support by the ladder to provide a stability with the foundation through the mast and adding to the load stability of the overall assembly through incorporation of the ladder, which in effect provides additional I-beam support.

The all welded assembly also incorporates structural features which enable the assembly to be moved and stacked by use of a fork truck. This is in stark contrast to the old method of using slings or having the unit roll on movable supports while being loaded and unloaded. The unique structure for accomplishing this is the incorporation of forklift pads at specific locations on the assembly to create a stable center of gravity and prevent the unit from falling during loading and unloading, preventing a worker from being injured.

A preferred dimensional feature of the platform width and the height of each platform assembly with a stacking bracket or cover secured to the mast base allows for four high and two set width on a standard 102 inch wide semi-trailer and the typical height requirement to meet highway regulations not being exceeded.

Other features, advantages and objects of the present invention will become apparent with reference to the following description and accompanying drawings.

BEST MODE FOR CARRYING OUT THE INVENTION

Figure 1:
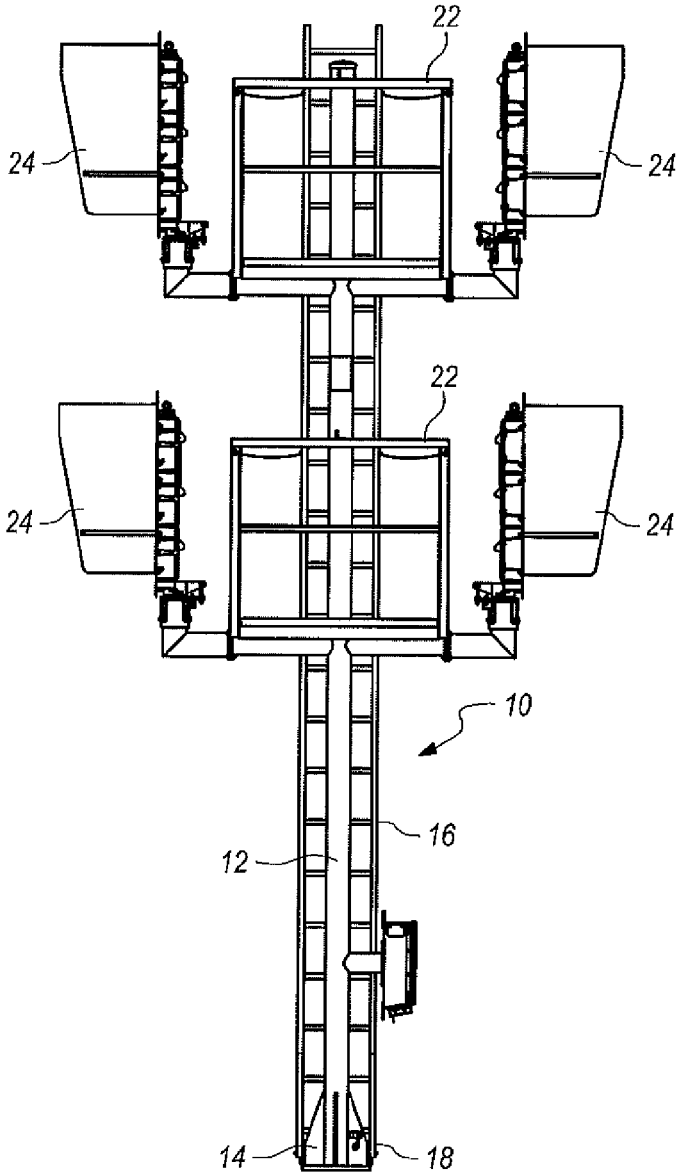
FIG. 1 is a front elevation view of a signal light assembly incorporating the teachings of the present invention supporting four signal lights.
Figure 2:
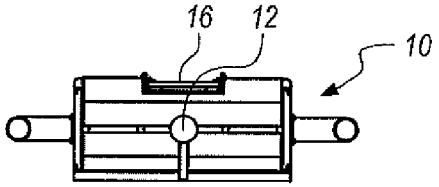
FIG. 2 is a top plan view of the assembly without signal lights.
Figure 3:
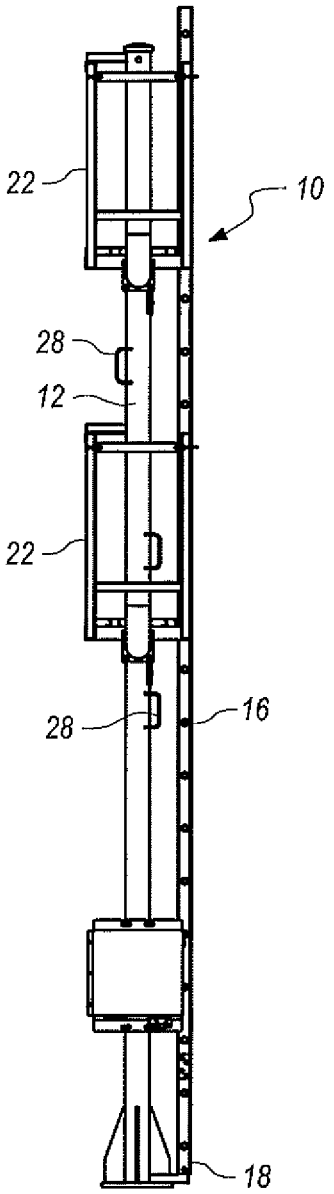
FIG. 3 is a side elevation view of the assembly without signal lights.
Figure 4:
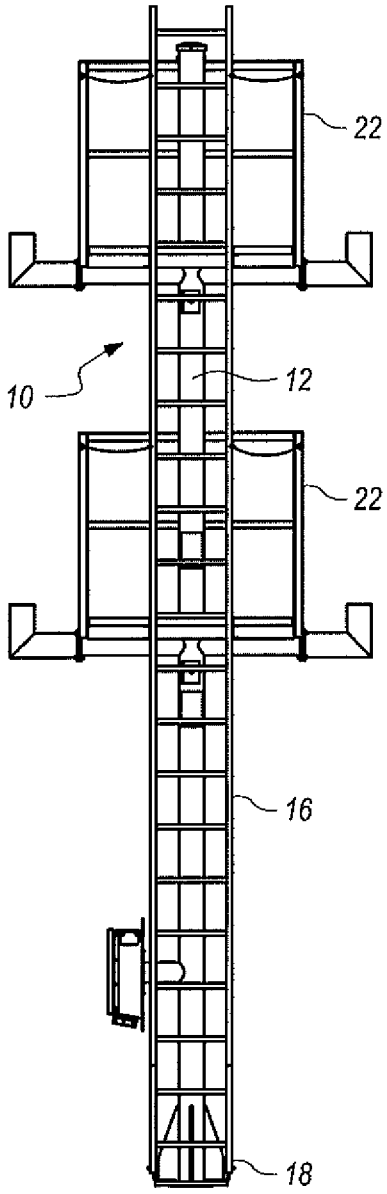
FIG. 4 is a back elevation view of the assembly without signal lights.

Referring now to the drawings, an all welded signal light assembly constructed in accordance with the teachings of the present invention is designated by reference numeral 10. Signal light assembly 10 is suitably constructed of aluminum and includes an elongated mast 12 having a mast base 14, an elongated ladder 16 extending along the elongated mast. The ladder 16 has a ladder base 18 positioned adjacent to the mast base 14 and spaced therefrom. The ladder is attached to the mast at locations along the lengths thereof and cooperates therewith to essentially provide an I-beam support increasing the load ability of the overall assembly.

The ladder base may be attached directly to an existing foundation by anchor bolts. The mast base 14 is also attached via anchor bolts or other suitable mechanical expedient to the foundation.

The all welded signal light assembly 10 also includes platforms 22 attached to and interconnecting the mast and the ladder at spaced locations therealong.

Figure 5:
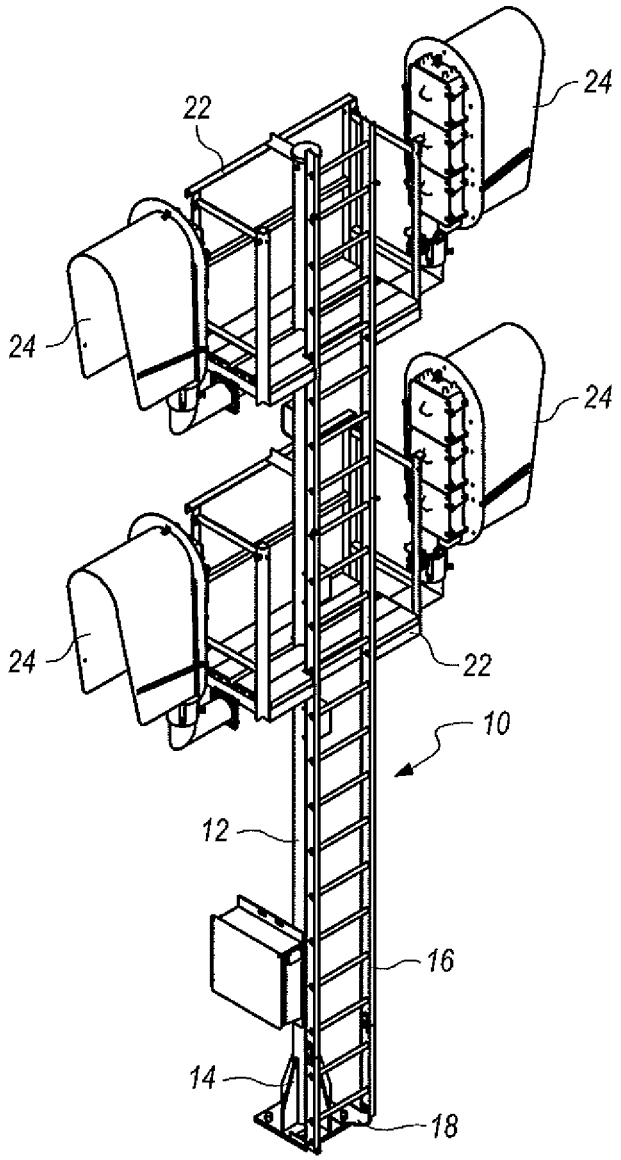
FIG. 5 is a top perspective view of the assembly with signal lights.
Figure 6:
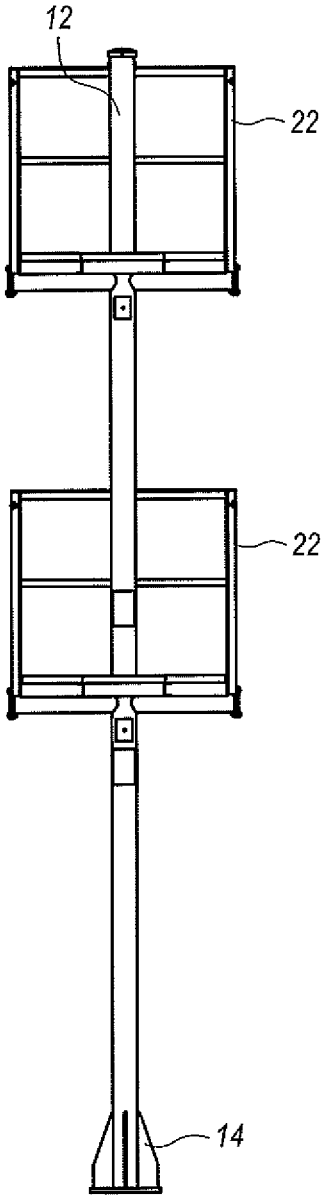
FIG. 6 is a front elevation view of the mast and platforms of the assembly.
Figure 7:
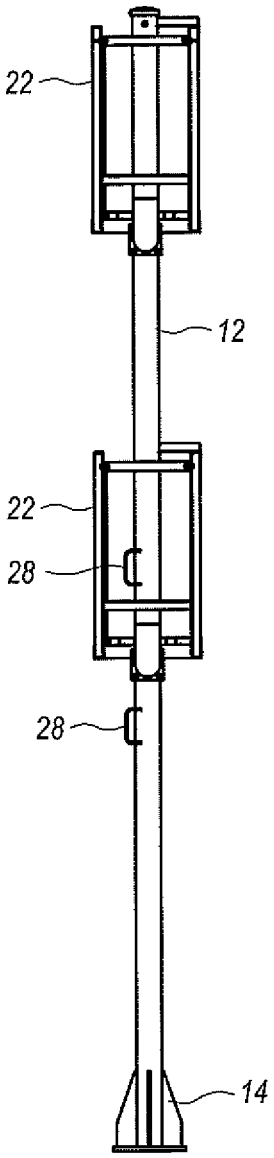
FIG. 7 is a side elevation view of the mast and platforms of the assembly.
Figure 8:
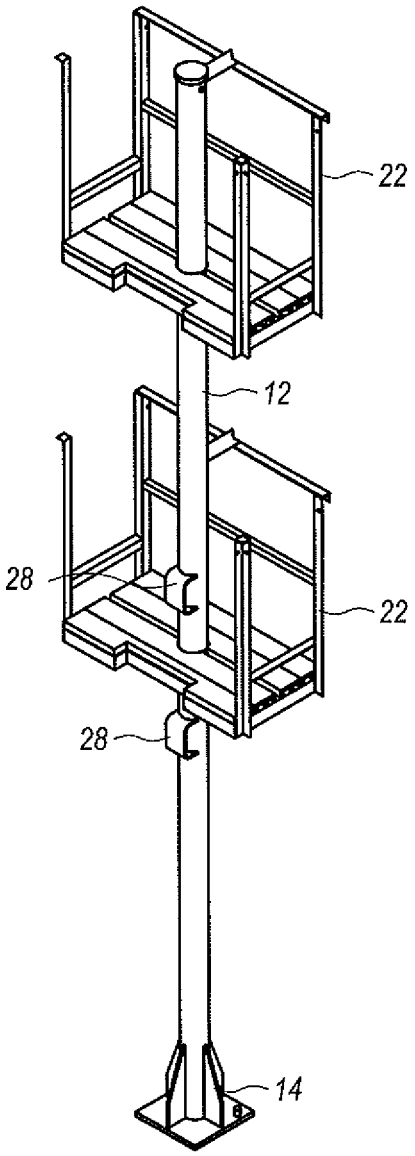
FIG. 8 is a top perspective view of the mast and platforms of the assembly.
Figure 9:
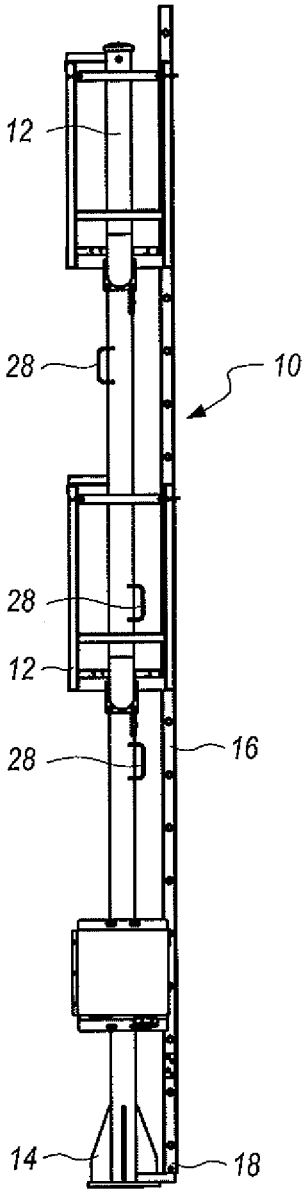
FIG. 9 is a side elevation view of the welded mast, platforms and ladder of the assembly.
Figure 10:
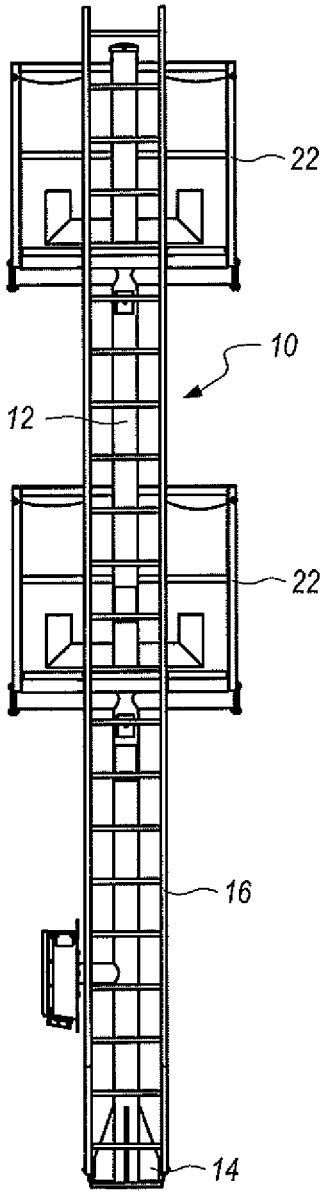
FIG. 10 is a back elevation view of the welded mast, platforms and ladder of the assembly.
Figure 11:
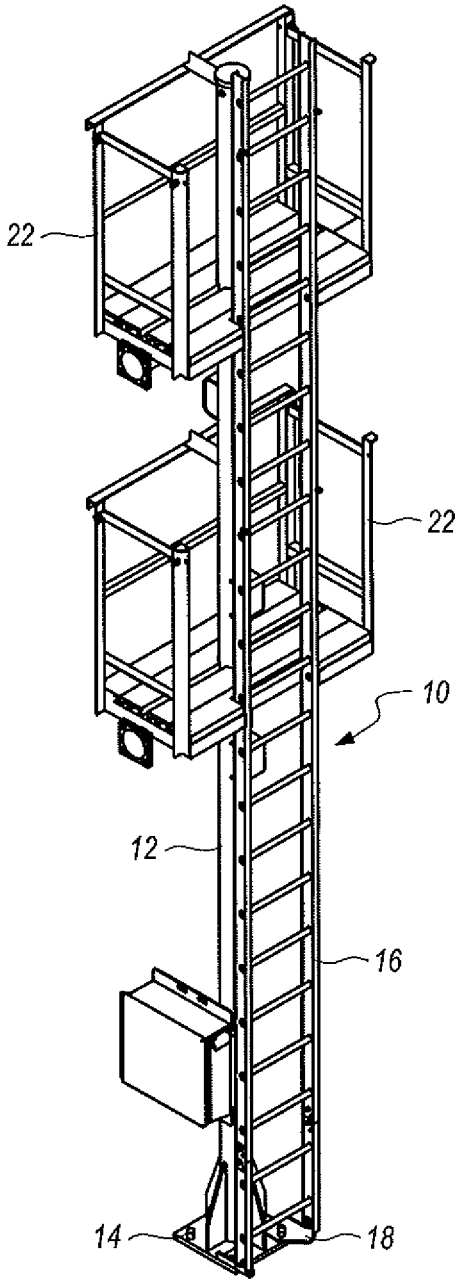
FIG. 11 is a perspective view of the welded mast, platforms and ladder of the assembly.

As shown in FIGS. 1 and 5, suitable signals such as signal lights 24 are attached to the assembly 10 at or adjacent to the platforms. These signals may be secured to the signal light assembly prior to the assembly being fully erected and installed at the foundation or thereafter.

Figure 12:
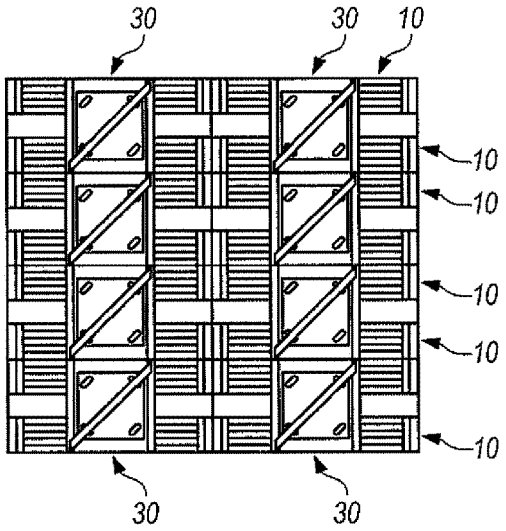
FIG. 12 is a reduced size bottom view illustrating a stack of assemblies suitable for storage and transport.
Figure 13:
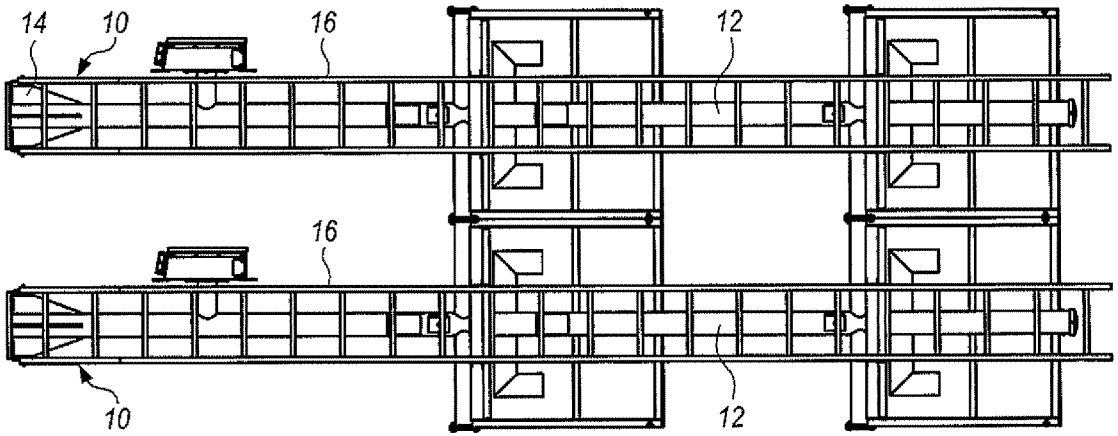
FIG. 13 is a side elevation view showing two assemblies in stacked condition and illustrating end stacking brackets at the bases of the masts in engagement when platforms of the masts are in engagement.
Figure 14:
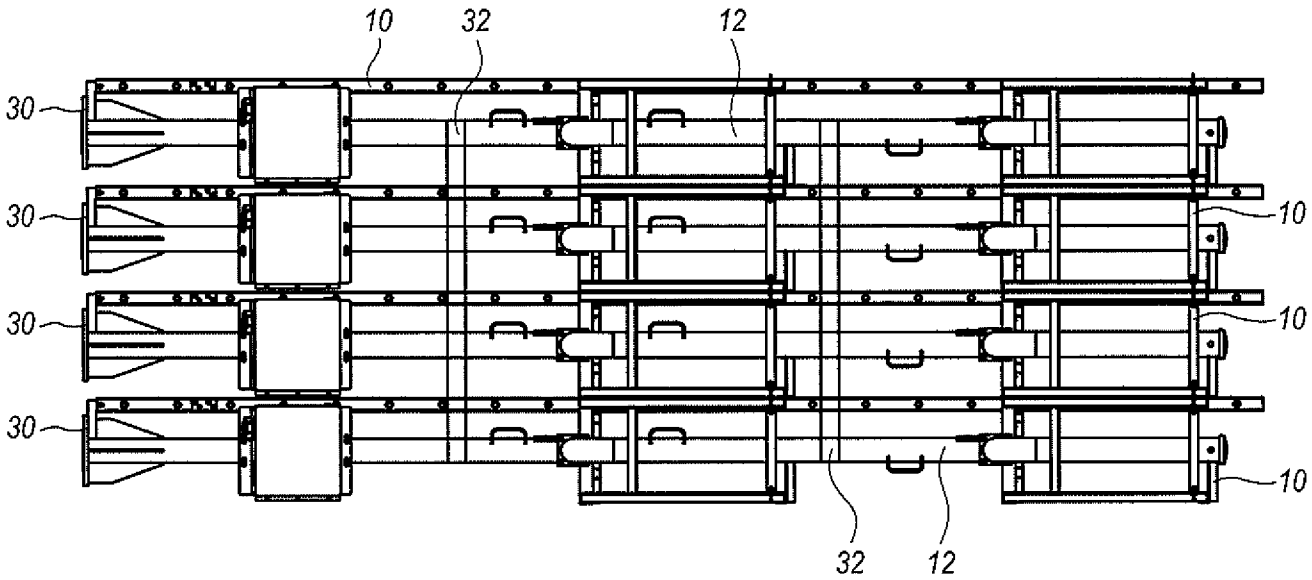
FIG. 14 illustrates four stacked assemblies.

An important aspect of the present invention resides in the fact that the signal light assembly 10 may be transported in stacked condition with a plurality of all welded signal light assemblies of like construction. For example, the assemblies may be stacked and transported by truck, the all welded signal light assemblies substantially unstacked and separately installed at selected locations. FIGS. 12-14 show a stacked plurality of all welded signal light assemblies 10.

Another unique feature of the signal light assembly 10 is incorporation of forklift pads 28. The forklift pads 28 welded to the mast enable the assemblies to be readily moved, stacked and unstacked. This is in stark contrast to the established prior art methods of using slings or of supporting assemblies in unsecured and unstable fashion on the upper surface arms of fork trucks or other movable supports while being loaded and unloaded.

Incorporation of the forklift pads 28 on the mast of signal light assembly 10 provides a safety feature not used in prior art assemblies by creating a stable center of gravity and preventing the assembly from falling during loading and unloading, thus preventing the possibility of a worker being injured during those operations.

The all welded signal light assembly has a substantially uniform maximum cross-sectional dimension at opposed end portions thereof to facilitate stacking and to ensure that the desired number of assemblies are accommodated on a semi-trailer or other delivery platform. More particularly, the outermost portions of the assembly are defined by opposed outer surfaces of the platforms 22. Referring to FIG. 12, for shipping purposes, a stacking bracket 30 is temporarily secured to the mast base so that the mast base is also supported to provide stability during shipment and compact efficient storage along with other signal light assemblies of like character. That is, stacking brackets 30 of adjacent stacked signal light assemblies will be in engagement during shipping when opposed outer surfaces of the platforms 22 of adjacent assemblies are in engagement.

When stacked, the signal light assemblies are secured together by ties such as bands or straps 32 wrapped about adjacent masts at predetermined mast locations between spaced ends of the masts. FIG. 14 shows stacking brackets in the form of shipping covers attached to the mast bases.

The invention claimed is:

1. A signal light assembly transportable in stacked condition with a plurality of signal light assemblies for unstacking and installation on foundations at selected locations, said signal light assembly including an elongated mast having a mast base, an elongated ladder extending along said elongated mast and secured thereto, said ladder having a ladder base positioned adjacent to said mast base and said mast base and said ladder base together forming a unitary base, and at least one platform affixed to said mast and to said ladder at a location spaced from said unitary base, said unitary base attachable directly to a foundation with said elongated mast and said ladder positioned spaced from one another and at two spaced points of contact between the mast and ladder of the signal light assembly and the unitary base stabilizing the signal light assembly on the foundation, said signal light assembly additionally including fork truck lift structures attached to said mast for engagement by a fork lift truck to lift and move the signal light assembly.

2. The signal light assembly of claim 1 wherein said fork truck lift structures are located at or closely adjacent to the center of gravity of the signal light assembly during lifting or transport by a fork lift truck.

3. The signal light assembly of claim 1 adapted for installation at said foundation by anchor bolts extending through said unitary base into said foundation.

* * * * *